United States Patent [19]

McCabe

[11] 4,218,910

[45] Aug. 26, 1980

[54] PRESS BRAKE

[76] Inventor: Francis J. McCabe, 239 Hastings Ct., Doylestown, Pa. 18901

[21] Appl. No.: 7,995

[22] Filed: Jan. 31, 1979

Related U.S. Application Data

[63] Continuation-in-part of Ser. No. 887,258, Mar. 16, 1978, which is a continuation of Ser. No. 736,823, Oct. 29, 1976, Pat. No. 4,080,860, which is a continuation-in-part of Ser. No. 650,926, Jan. 21, 1976, Pat. No. 4,004,480.

[51] Int. Cl.[3] ..... B21D 5/02

[52] U.S. Cl. ..... 72/389; 72/450; 100/271; 83/530; 83/606

[58] Field of Search ..... 72/389, 450, 386, 453.03, 72/429; 100/270, 271, 272; 83/530, 604, 606, 634, 639

[56] References Cited

U.S. PATENT DOCUMENTS

| | | | |
|---|---|---|---|
| 5,067 | 4/1847 | Derall | 100/271 |
| 1,038,934 | 9/1912 | Mode | 100/270 |
| 1,488,562 | 4/1924 | Spaulding | 100/271 |
| 2,224,968 | 12/1940 | Klocke | 100/271 |
| 2,241,794 | 5/1941 | Stull | 100/270 |
| 2,890,649 | 6/1959 | Hodges | 100/231 |
| 3,196,700 | 7/1965 | Gron | 100/271 |
| 3,196,727 | 1/1965 | Pray | 83/601 |
| 3,230,812 | 1/1966 | Pucci | 83/601 |
| 3,587,286 | 6/1971 | Fritich | 72/450 |
| 3,690,207 | 9/1972 | McCabe | 83/627 |
| 3,968,714 | 7/1976 | Kuchyt | 83/639 |

FOREIGN PATENT DOCUMENTS

| | | | |
|---|---|---|---|
| 561487 | 10/1957 | Belgium | 72/450 |

*Primary Examiner*—Francis S. Husar
*Assistant Examiner*—Gene P. Crosby
*Attorney, Agent, or Firm*—Benasutti Associates, Ltd.

[57] ABSTRACT

A novel press brake is disclosed which incorporates a double lever actuating mechanism which is easily adjustable to vary the stroke of the press brake as well as adjusted to counteract the rotational forces imparted to the ram by reason of differential resistances created by the workpiece during the forming operation.

7 Claims, 6 Drawing Figures

PRESS BRAKE

CROSS-REFERENCE TO RELATED APPLICATIONS

The present application is a continuation-in-part of my prior copending Pat. application Ser. No. 887,258, filed Mar. 16, 1978, entitled "PRESS", which, in turn, is a continuation of Pat. application Ser. No. 736,823, filed Oct. 29, 1976, entitled "PRESS", now U.S. Pat. No. 4,080,860, which, in turn, is a continuation-in-part of U.S. Pat. application Ser. No. 650,926, filed Jan. 21, 1976, entitled "PRESS", now U.S. Pat. No. 4,004,480, each of which patent applications is hereby incorporated by reference as if fully set forth herein.

The present application is also related to my prior issued U.S. Pat. No. 3,690,207, dated Sept. 12, 1972.

BACKGROUND OF THE INVENTION

The present invention relates generally to the field of presses, and, more particularly, to the field of press brakes which are intended to form or stamp relatively elongate portions of sheet material workpieces, such as sheet metal. In particular, the present invention relates to such presses which are actuated by fluidic actuators, such as pneumatic pistons and cylinders. In the prior art, presses actuated by various means, including pneumatic pistons and cylinders, have utilized punch and die sets to perform work on a workpiece. Pneumatically actuated presses have generally been limited to light duty work since pneumatic systems are limited in capacity. Some examples of prior art presses are illustrated in U.S. Pat. Nos. 1,038,934, 1,488,562, 2,241,794 and 3,230,812.

In U.S. Pat. No. 3,968,714, dated July 13, 1976, a shear is disclosed comprising, in part, a hydraulic power cylinder and a lever for drivingly connecting the power cylinder to a movable blade, the lever being pivotally mounted upon the frame to provide oppositely extending lever portions, one pivotally connected to the movable blade and the other pivotally connected to the ram of the power cylinder. This patent also discloses a roller journal mounted upon brackets to extend across the frame with the brackets selectively adjustably movable to position the roller, and springs for yieldably urging the movable blade against the roller.

In U.S. Pat. No. 3,196,727 (Pray) a similar hydraulic shear is disclosed, wherein a hydraulic cylinder mechanism may be utilized to oscillate a movable shear arm. Active portions of the stationary shear arm and the movable shear arm support the cutting blades which are positioned to overhang one of the sides of a tank structure which forms the supporting frame of the shear mechanism. More recently, in the patents and patent applications referred to above, particularly as shown in U.S. Pat. Nos. 4,004,480; 4,080,860 and 3,690,207, each of which patents is hereby incorporated by reference, significant advances have been made in the art of amplifying forces provided by pneumatic or hydraulic actuators through level-type amplifying means which apply forces to movable punch portions while minimizing shearing (transverse) forces applied by the amplification means to the punch portion.

Unique difficulties are encountered in the field of press brakes, particularly since such brakes typically are used to stamp or form relatively long portions of sheet material. By way of example, such press brakes may be used to form lengths of gutter material, lengths of architectural metal work, such as cornices, and other sheet metal objects which typically are formed into lengths which have relatively uniform cross-sections from one end to the other. A major difficulty which is encountered in carrying out forming operations on lengths of sheet material, however, is that differential resistances which are encountered from one end of the die to the other interfere with the forming operation. These differing resistances result from a number of variables, such as punch and die set tolerances, sheet metal thickness variations, wear, the presence of foreign materials, etc. While the variations in encountered resistance from one end of the die set to the other may be slight, the effects of such differential resistances on the finished workpiece can be substantial, since complete closure of the punch and die set with uniform pressure along its entire length should result in order to ensure a uniform bending or stamping operation. Slight differences from end to end in force and/or closure can result in substantial differences in the finished product. Additionally, differential resistances along the length of the punch and die set tend to impart slight rotational forces on the moving ram of the press brake which can tend to cause that ram to bind along its track, thereby amplifying the problem and further impairing the quality of the finished product.

SUMMARY OF THE INVENTION

The primary object of the present invention is the provision of an improved press brake with an actuating assembly which is both low cost and extremely easy to adjust, such that forces applied by that actuating assembly to the press brake ram may selectively distributed to easily compensate for differential resistances which may be encountered upon the closure of that ram upon a relatively elongate workpiece.

The present invention basically comprises a press brake assembly which is actuated through a novel actuator means which is designed to facilitate fine adjustment of the relative forces applied to a force amplification means comprising a plurality of lever means for applying forces to remote, spaced apart undersurface points on the press brake ram.

In the preferred embodiment, the press brake comprises a fixed die mount which is supported above a base plate by a plurality of tracks which have journaled therealong a movable ram. The opposing surfaces of the die mount and ram are adapted to receive a die and punch, respectively. In the preferred embodiment, the force amplification means comprises a plurality of lever assemblies which support the ram above the base plate and are capable of moving the ram towards the fixed die mount in response to forces received from the actuator means. These levers are preferably symmetrically positioned with respect to an axis which bisects the longitudinal axis of the punch and die parts.

In the preferred embodiment, the actuator means for applying forces to the amplification means comprises a mounting bar which is pivotally attached to the base plate of the press brake, an actuating cylinder mounted on said bar and having a cylinder rod which is connected through cables or rods to the remote ends of each of the lever assemblies. The point of pivotal attachment of said bar to said base plate is preferably disposed along said bisecting axis. An actuator arc adjustment means for adjusting the axis of the cylinder relative to the axis of ram movement is provided so that slight adjustments in the orientation of the cylinder (and resulting power stroke) are easily accomplished. Such adjustments correspondingly adjust the amount of force to be applied to the relative points at which force is transmitted to the ram through the respective lever assemblies, thereby enabling the operator of the press brake to compensate for differential resistances which may be met in performing any particular work operation. Preferably, the mounting bar also comprises a stop for directly limiting the actuator cylinder stroke, to thereby control the degree of ram-die mount closure.

As seen from the above, an extremely simple, inexpensive, sophisticated press brake is disclosed which represents a substantial advance over those heretofore known to the art.

DETAILED DESCRIPTION OF THE PREFERRED EMBODIMENTS

Figure 1:
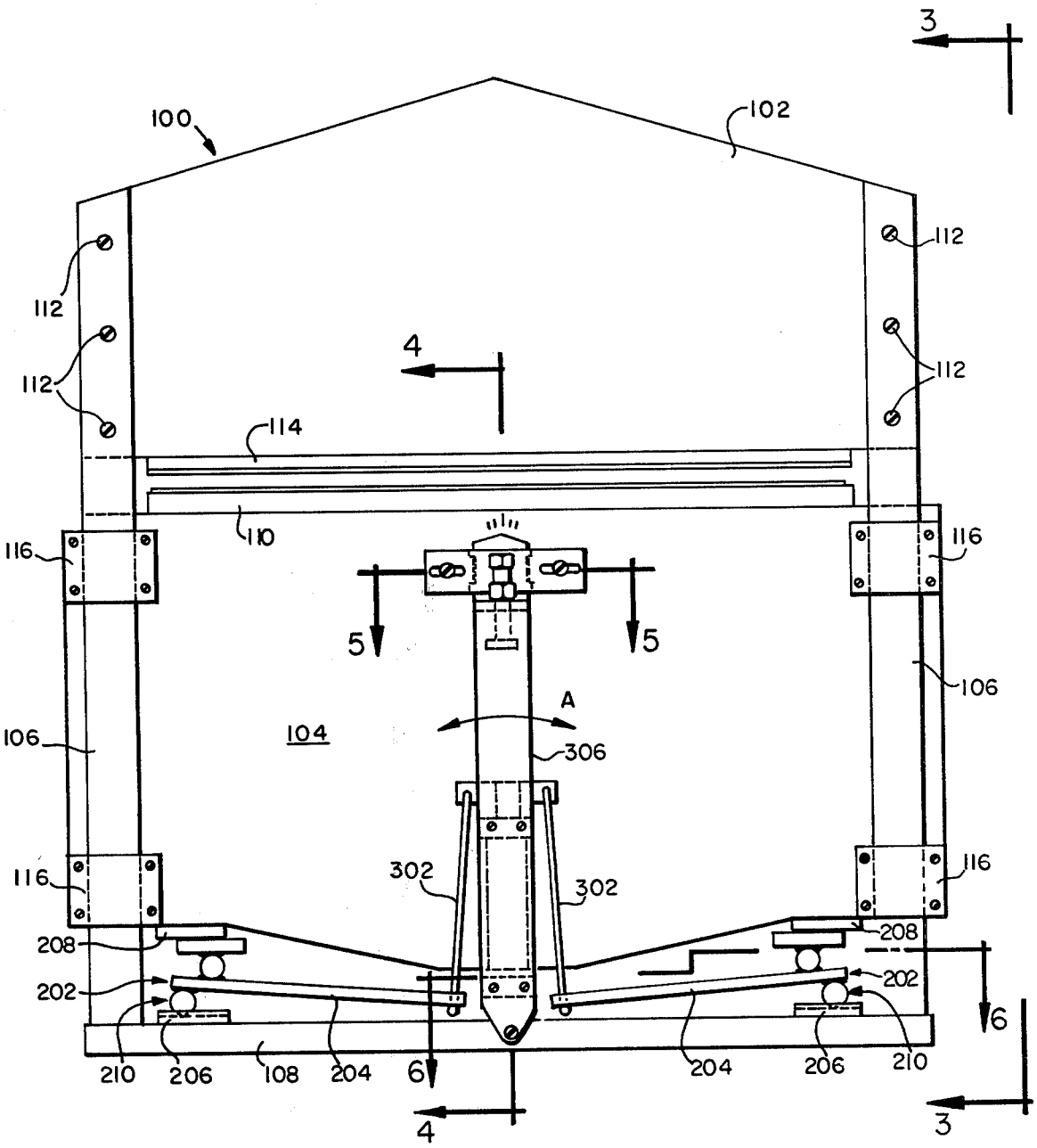
FIG. 1 is a front plan view of the preferred embodiment press of the present invention, said press being in the open position.

Although specific forms of the invention have been selected for illustration in the drawings, and the following description is drawn in specific terms for the purpose of describing these forms of the invention, this description is not intended to limit the scope of the invention which is defined in the appended claims.

Referring now to the drawings, and particularly FIG. 1, the preferred embodiment press brake designated generally 100 is seen to comprise a fixed die mount 102, which is supported on a plurality of tracks 106, which are mounted on base plate 108. Bolts 112 fasten the tracks 106 to the fixed die mount 102. The lower longitudinal surface of fixed die mount 102 has fitted thereon a die 114. Journaled for reciprocating movement along the axis of tracks 106 is a reciprocating, movable ram 104, the upper longitudinal surface of which is fitted with a punch 110 which is complimentally configured with respect to opposing die 114 so that material compressed therebetween will be shaped in the desired manner upon closure of the punch 110 relative to the fixed die mount 102. As shown in the figures, the journaling of the movable ram 104 with respect to the tracks 106 is accomplished by a plurality of main journaling brackets 116, which are bolted around each of the tracks 106 and into the movable ram 104 near the corners thereof. It is within the scope of the present invention to use alternate track and ram journaling means for journaling the movable ram portion along a track means for slidable movement along a reciprocating axis relatively towards and away from the fixed die mount 102. It is believed that current economics are such that it is not practically feasible to provide journaling mechanisms which absolutely resist rotational forces which may be applied against movable ram 104 such that no binding or "cocking" of the ram upon closure will in fact occur. Accordingly, even though other journaling mechanisms, such as ball bearing journals, etc. may be substituted for the journaling means disclosed in the drawings, it is nonetheless anticipated that some "play" in the journaling of the movable ram, at least in the order of several thousandths of an inch, will inevitably occur if these rotational forces are not effectively counteracted.

As seen from the drawings, and particularly FIG. 1 thereof, which shows the apparatus in its open position, the movable ram 104 rests upon a plurality of lever mechanisms designated generally 202, which together comprise the force amplification means for amplifying the force supplied by the actuator means and for transmitting that force to the movable ram for selectively moving that ram towards and away from the fixed die mount 102. Each lever mechanism basically comprises a lever member 204, a lever mounting plate 206, a lever punch plate 208 and a fulcrum bearing assembly designated generally 210. In the drawings, the details of the preferred embodiment fulcrum assemblies 210 are not illustrated, however, similar fulcrum assemblies are illustrated in my prior U.S. Pat. No. 3,690,207, dated Sept. 12, 1972, and in my prior issued U.S. Pat. Nos. 4,080,860 and 4,004,480, each of which patents are also incorporated by reference. Please refer to these prior issued United States patents for complete descriptions of the preferred embodiment fulcrum assemblies which may be incorporated in the preferred embodiment press brakes of the present invention. The best mode fulcrum assembly of the present invention is similar to that disclosed in U.S. Pat. No. 4,004,480. Referring now to my prior U.S. Pat. No. 4,004,480, dated Jan. 25, 1977, and in particular to FIGS. 1, 2 and 3 of this patent, lever mounting plate 206 of the presently described device corresponds to thrust block 60 of that patent disclosure, level member 204 to lever arm 44 of that patent disclosure, lever punch plate 208 to fulcrum plate 88 of that patent disclosure, and the remaining diagrammatically represented portions of the fulcrum assembly in the present disclosure to the more detailed disclosure and description thereof in the above-mentioned patent disclosure. It will be noted that there are certain differences between the lever mechanisms shown in the drawings of the present application and those shown in the drawings of U.S. Pat. No. 4,004,480. First, in that patent disclosure fulcrum plate 88 is fixed and thrust block 60 is movable, while their corresponding parts in the preferred embodiment press brake of the present invention are movable and fixed, respectively. Additionally, fulcrum plate 88 in the patent disclosure is slightly inclined with respect to the axis of travel of the portion of the assembly to be moved in response to activation of lever 44. While such an incline of, for example, lever punch plate 208 is possible, the use of two symmetrical lever assemblies counteracts the shearing forces which are created by the internal friction thereof, making such an incline of lever punch plate unnecessary. While the above described lever mechanism is the best mechanism contemplated at this time for use with the press brake herein described, one or ordinary skill in the art will recognize that my other lever and fulcrum assemblies as described in my above-mentioned and incorporated patents and patent applications are also suited for use in alternate embodiments of the present invention.

Figure 6:
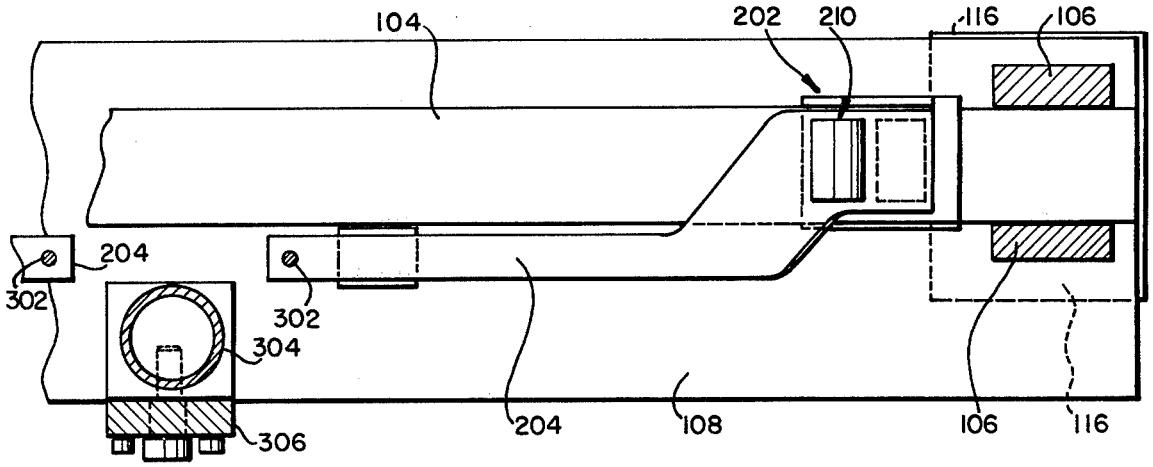
FIG. 6 is a fragmentary, partially cross-sectioned top view on an enlarged scale of a portion of the press brake illustrated in FIG. 1, taken as indicated by the lines and arrows 6—6 in FIG. 1.

At the remote ends of each of the lever members 204, attachment to actuating cables 302 is provided. As seen particularly in FIG. 6, the preferred embodimemt lever members are configured so that the remote ends thereof adjacent to the fulcrum assemblies 210 are disposed directly under portions of the movable ram 104 for supporting the same. The levers are, however, configured so that the remote ends thereof are slightly offset with respect to the plane of the ram 104 so that their intersection with cables 302 occurs at a point which does not interfere with ram 104. While in the preferred embodiment an offset is produced by configuring the lever members with S or Z-shaped end portions, it is also within the scope of the present invention to use relatively straight lever members which are simply angled along an axis extending from the actuating cylinder 304 towards fulcrum assemblies 210, which assemblies may be similarly reoriented for alignment along those axes.

Figure 2:
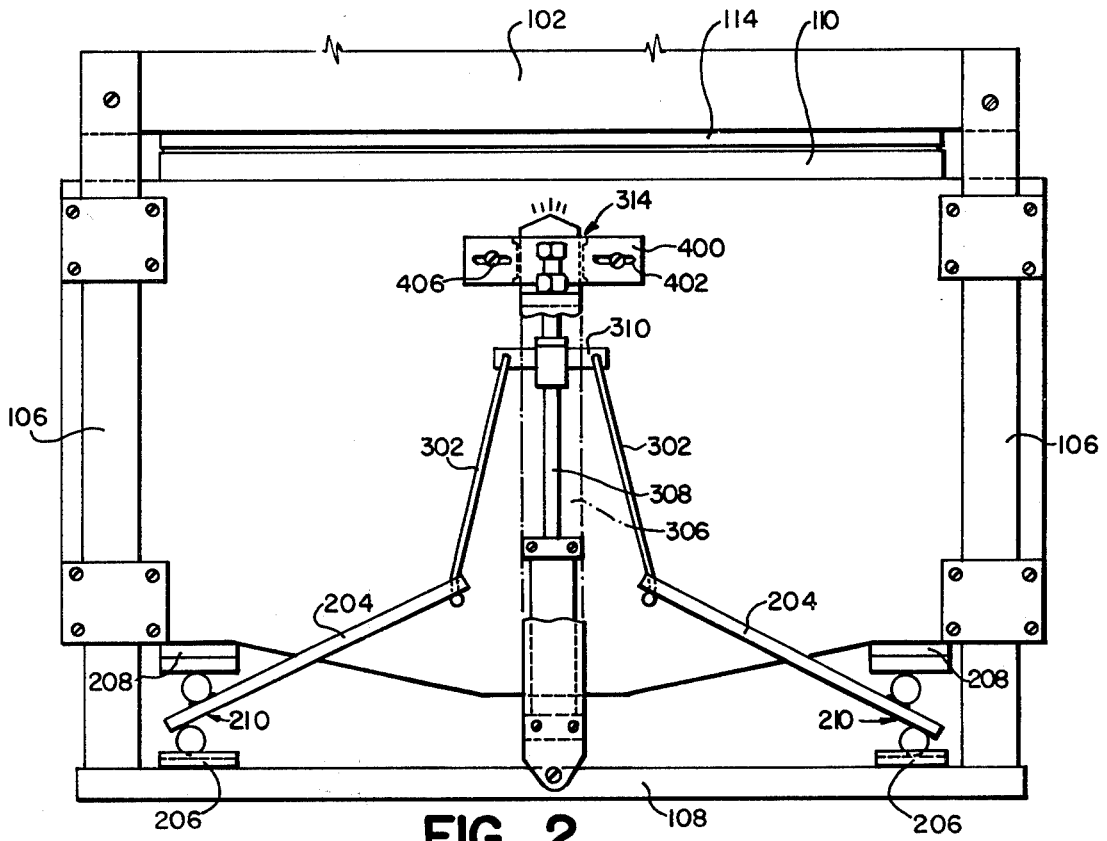
FIG. 2 is a fragmentary front view of a portion of the preferred embodiment press shown in FIG. 1 moved to a closed position.

As seen in the drawings, and particularly by comparison between FIGS. 1 and 2, actuation of the press is accomplished by moving the remote ends of the lever members 204 generally away from the base plate into the actuated position shown in FIG. 2, whereupon the fulcrum assemblies have effectively lifted the ram 104 into its desired end position with respect to die 114. The actuation of the device is caused through actuation of cylinder 304, which is a fluidic cylinder, preferably a pneumatic cylinder. As seen particularly in the drawings, the actuator means for applying force to the force amplification means of the present invention basically comprises the aforementioned fluidic cylinder 304, cylinder mounting means pivotally attached to base plate 108 for mounting cylinder 304 with respect to the apparatus, cylinder rod 308, T-bar 310 for interconnecting the cylinder rod 308 to cables 302, cylinder rod stop means designated generally 312 (FIG. 4) and an actuator arc adjustment means for adjusting the axis of the cylinder relative to the axis of ram movement. This actuator arc adjustment means is designated generally 314 in the drawings.

Figure 5:
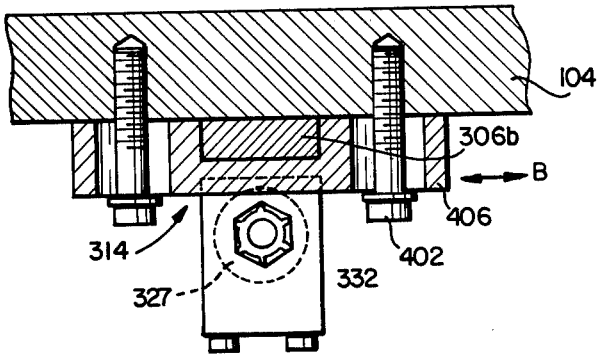
FIG. 5 is a cross-sectional view of a portion of the preferred embodiment press brake illustrated in FIGS. 1–4, taken on a greatly enlarged scale as indicated by the lines and arrows 5—5 in FIG. 1.
Figure 3:
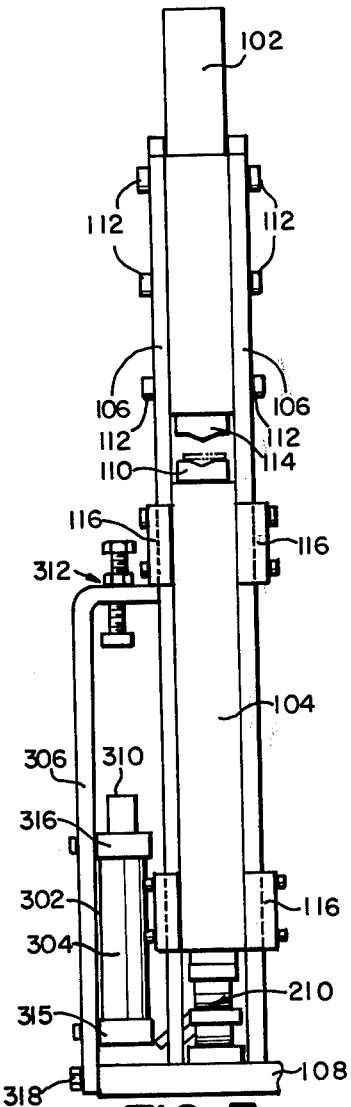
FIG. 3 is a side view of the preferred embodiment press brake illustrated in FIGS. 1 and 2, taken as indicated by the lines and arrows 3—3 on FIG. 1.
Figure 4:
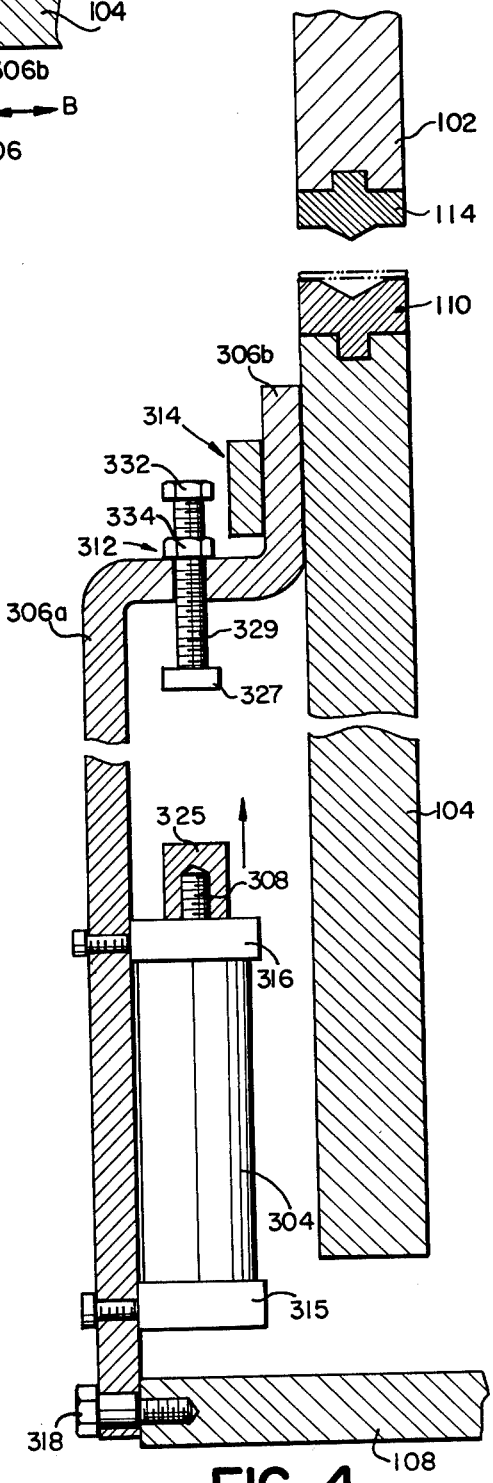
FIG. 4 is a fragmentary cross-sectional view of the preferred embodiment press brake illustrated in FIGS. 1–3, taken as indicated by the lines and arrows 4—4 in FIG. 1, this view being taken on an enlarged scale.

The details of the actuator means are shown particularly in FIGS. 3, 4 and 5 of the present disclosure. In FIG. 3 the overall relationship of the actuator means to other portions of the press brake is clearly illustrated. Cylinder 304 is rigidly mounted by cylinder mounting brackets 315 and 316 to cylinder mounting bar 306 which is pivotally attached through pivot pin 318 to base plate 108. Cylinder mounting bar 306 has several right angles formed in the remote end thereof to create a transverse portion **306*a* through which the stop means 312 designated generally 312 is mounted and a remote parallel portion 306*b* which is journaled through the actuator arc adjustment means and which slidably engages a surface of movable ram 104**.

As seen particularly in FIG. 4, cylinder rod 308 has fitted on the head thereof an elastomeric cushion 325 so that when the cylinder rod 308 is extended the elastomeric cushion 325 will hit and be limited by a head 327 of the stop means, which is preferably an enlarged end portion of a threaded rod 329 having a lock nut 331 and hex head 332 associated therewith. Although not shown in the drawings, instead of a hex head 332 it is within the scope of the present invention to provide a lever handle so that quick hand adjustments of the stop means may be made to slightly adjust the ultimate travel of ram 104, and consequently, the forming operation to be preformed upon actuation of the fluidic cylinder. Referring now in particular to the actuator arc adjustment means 314, a simple and effective method is provided for adjusting the axis of power stroke of the cylinder with respect to the axis of movement of the ram 104. The actuator arc adjustment means comprises a journaling bracket 400 having a plurality of slots defined therein for receiving adjusting bolts 402 and 406. Since the interior surfaces of the journaling channel defined within journaling bracket 400 are convex surfaces, lateral (transverse) adjustment of the position of the journaling bracket 400 along the slots defined therein will not cause remote cylinder mounting bar 302 to bind thereagainst during its reciprocal movement therein, but will nonetheless maintain the cylindrical axis within acceptable tolerances.

From the above description, the operation of the press brake of the present invention may now be understood as follows. When it is desired to form a particular sheet of material into a desired shape, an appropriate punch 110 and die 114 are selected for mounting upon movable ram 104 and fixed die mount 102, respectively. Depending upon the configuration of the dies and the various other factors which will create relatively greater resistance at one end of the die-punch interface as opposed to the other end, it may then be desired to adjust the relative arc of the actuator means, as indicated by arc A shown in FIG. 1. This adjustment is accomplished by loosening bolts 402 and 406 and adjusting the actuator arc adjustment means by moving journaling bracket 400 in the directions as shown by double-ended arrow B in FIG. 5. Once a suitable adjustment has been made to counteract such rotational forces, these bolts are retightened, and the degree of desired closure of the punch 110 with respect to die 114 is adjusted by loosening nut 331 and rotating threaded rod 329 by means of the hexagonal end 332 thereof to appropriately position stop plate 327 to engage the elastomeric portion 325 of the cylinder rod in its preferred location to effect the proper amount of closure of ram 104 with respect to fixed die mount 102. The apparatus is then ready for actuation by supplying suitable pneumatic or hydraulic pressure to cylinder 304 to cause the cylinder rod 308 to extend into the position shown in FIG. 2, whereupon force will be applied by the actuator means through the force amplification means to symmetrically positioned locations on the lower surface of the movable ram to cause the closure of that ram with respect to the fixed die mount, to thus perform the desired operation. As mentioned above, the adjustment of the axis of the actuator rod will, if not parallel with the axis of travel of the ram, cause a slight difference in the amount of force which is applied by the actuator means to each of the lever mechanisms. By slightly tilting the actuator means towards one side of the axis of ram travel, the path of travel of the remote end of that lever mechanism will be caused to travel a somewhat different path with respect to one remote lever end than the other thereby adjusting the amount of force applied by each lever mechanism to the ram. Accordingly, the press brake of the present invention readily enables the production of a superior product by reason of the ability of the mechanism to use an inexpensive actuator and to adjust and limit the stroke and force applied by that actuator to produce a well-controlled power stroke.

In alternate embodiments of the present invention, it is not necessary to mount the actuator arc adjustment means directly onto the movable ram 104, but rather the actuator arc adjustment means may be mounted in a fixed position with respect to the base plate, either by means of extending the cylinder mounting bar upward so that the actuator means is mounted into the fixed die mount 102, or otherwise, by means of mounting the actuator means on members extending to tracks 106, or directly down to base plate 108. Additionally, while slots defined in the actuator journaling bracket and complimentally disposed bolts are described as one method of adjusting the position of that journaling bracket, one of ordinary skill in the art will readily appreciate that the relative adjustment of the journaling bracket, and thus the arc or position of the cylinder may be accomplished using a rack and pinion type of adjustment wherein the pinion is fitted with a handle for easy manipulation. Finally, one of ordinary skill in the art will appreciate that the T-bar 310 represents only one method of attaching cables 302 to the end of the piston rod. For example, a single cable may be substituted for cables 302, which cable may extend over a groove defined in the end of the piston rod.

It will be understood that various changes in the details, materials and arrangement of parts which have been herein described and illustrated in order to explain the nature of this invention may be made by those skilled in the art within the principle and scope of the invention as expressed in the following claims.

I claim:

1. A press brake comprising:

(a) a frame;

(b) a horizontally elongate die mount, said die mount fixed with respect to said frame;

(c) a horizontally elongate ram mount mounted opposite said die mount for reciprocal movement with respect to said die mount;

(d) a single actuating means for causing said reciprocal movement of said ram with respect to said die mount said actuating means affixed to a support member having a first end mounted on said frame and a free end slideably positioned adjacent said ram mount by a mounting collar; and (e) force amplification means attached to said actuating means for amplifying force applied by said actuating means and for transmitting said force to said ram mount at at least two spaced apart positions along the elongate axis of said ram.

2. The invention of claim 1 wherein said force amplification means comprises a plurality of lever means for amplifying said forces applied by said actuating means and for transmitting said forces to said ram at at least two spaced apart positions.

3. The invention of claim 2 wherein each of said lever means are symmetrically spaced with respect to an axis bisecting the elongate axis of said ram, to thereby apply force to said ram at symmetrically disposed points along said elongate axis.

4. The invention of claim 1 wherein said first end of said support member is pivotally mounted on said frame.

5. The invention of claim 4 wherein said support member further comprises an arc adjustment means for adjusting the relative position of said support member and said actuating means with respect to the axis of reciprocal movement of said ram.

6. The invention of claim 5 wherein said actuator means further comprises a fluidic cylinder, a cylinder rod journaled at one end therewithin, and attachment means extending from the free end of said cylinder rod to said force amplification means for transferring motion to said force amplification means.

7. The invention of claim 6 wherein said actuating means further comprises a stop means for selectively limiting the distance of travel of said cylinder rod to thereby adjust the length of travel of said ram.

* * * * *